US007778557B2

(12) United States Patent
Mashiba

(10) Patent No.: US 7,778,557 B2
(45) Date of Patent: Aug. 17, 2010

(54) FIXING APPARATUS AND IMAGE FORMING APPARATUS

(75) Inventor: Tamaki Mashiba, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 804 days.

(21) Appl. No.: 11/604,265

(22) Filed: Nov. 27, 2006

(65) Prior Publication Data

US 2007/0122170 A1 May 31, 2007

(30) Foreign Application Priority Data

Nov. 28, 2005 (JP) ..... 2005-342166

(51) Int. Cl.
*G03G 15/20* (2006.01)

(52) U.S. Cl. ..... 399/33

(58) Field of Classification Search ..... 399/33
See application file for complete search history.

(56) References Cited

U.S. PATENT DOCUMENTS 7,587,147 B2 * 9/2009 Mashiba ..... 399/33

FOREIGN PATENT DOCUMENTS

JP 5-119671 A 5/1993
JP 2000-227732 8/2000
JP 2001-109316 4/2001
JP 2003-149981 A 5/2003
JP 2004-151471 A 5/2004
JP 2004-334103 11/2004

OTHER PUBLICATIONS

Japanese Office Action mailed Feb. 10, 2009 in corresponding Japanese application 2005-342166.

* cited by examiner

*Primary Examiner*—David M Gray
*Assistant Examiner*—Erika Villaluna
(74) *Attorney, Agent, or Firm*—Nixon & Vanderhye, P.C.

(57) ABSTRACT

In a fixing apparatus that has a heating roller, and heats a sheet where an image by a developer has been transferred, to thereby fix the image on the sheet, the following are provided: a first sensor that detects the radiant heat from the heating roller; a second sensor that detects the ambient temperature of the first sensor; a computing circuit that computes a threshold value for determining whether the temperature of the heating roller is abnormal or not; and a controlling circuit that controls the operation condition of the heating roller based on output values of the first sensor and the second sensor and the threshold value computed by the computing circuit.

7 Claims, 8 Drawing Sheets

FIXING APPARATUS AND IMAGE FORMING APPARATUS

CROSS-REFERENCE TO RELATED APPLICATIONS

This Nonprovisional application claims priority under 35 U.S.C§119(a) on Patent Application No. 2005-342166 filed in Japan on Nov. 28, 2005, the entire contents of which are hereby incorporated by reference.

BACKGROUND

1. Field of the Invention

The present invention relates to a fixing apparatus capable of preventing the excessive temperature rise of a heating roller, and an image forming apparatus having the fixing apparatus.

2. Description of Related Art

For image forming apparatuses such as copiers and printers, a heating-type fixing apparatus is widely used to fix a toner image transferred onto a recording sheet, on the recording sheet. The heating-type fixing apparatus is provided with a heating roller having heating means such as a heater and a pressure roller pressed against the heating roller. The recording sheet where a toner image has been transferred is passed between the heating roller and the pressure roller while being sandwiched therebetween, the toner on the recording sheet is fused, and pressurization is further performed, whereby the toner image is fixed on the recording sheet.

In such a fixing apparatus, it is necessary to accurately control the surface temperature of the heating roller in order to reliably fuse the toner on the recording sheet and prevent an adverse effect on the recording sheet. Therefore, conventionally, a plurality of thermistors are pressed against the surface of the heating roller, the temperatures of the center and edge of the surface of the heating roller are detected and the power supply to the heater is controlled, whereby the overall surface temperature of the heating roller is maintained uniform.

However, when the surface temperature of the heating roller is accurately measured by using the thermistors, it is necessary to press the thermistors against the surface of the heating roller with a predetermined pressure. For this reason, the thermistors are continuously pressed against the same parts of the heating rollers, so that the surface of the heating roller is deteriorated due to the friction between the thermistors and the surface of the heating roller and this degrades the fixing performance. In addition, since dirt on the surface of the heating roller adheres to the surfaces of the thermistors, the accurate temperature cannot be detected.

Therefore, to solve these problems, a fixing apparatus and an image forming apparatus are proposed in which the surface temperature of the heating roller is detected by an infrared sensor in a noncontact manner. For example, a fixing apparatus and an image forming apparatus are proposed in which even when the infrared emissivity of the heating roller differs according to the difference in color or material quality, the surface temperature of the heating roller can be accurately detected by correcting the temperature detected by the infrared sensor based on an emissivity-responsive signal corresponding to the infrared emissivity of the heating roller (see Japanese Laid-Open Patent Application No. 2000-227732).

Moreover, an image forming apparatus is proposed in which two areas having different infrared output characteristics are provided in a predetermined area of the heating roller and by detecting the temperatures of the two areas by an infrared sensor, temperature detection can be highly accurately performed even when the surface color of the heating roller is different (see Japanese Laid-Open Patent Application No. 2001-109316).

The noncontact-type temperature sensors described in Patent Document 1 and Patent Document 2 detect the surface temperature of the heating roller by detecting the infrared rays emitted from the surface of the heating roller, and has inside an infrared detecting thermistor and a temperature compensating thermistor. The infrared detecting thermistor detects the infrared rays emitted from the surface of the heating roller, and the output voltage thereof depends on the ambient temperature (that is, the temperature of the infrared detecting thermistor itself). To compensate for such temperature dependence, it is necessary to detect the temperature of the infrared detecting thermistor itself. Therefore, the temperature compensating thermistor is disposed in a position near the infrared detecting thermistor and not affected by the infrared rays emitted from the surface of the heating roller.

The temperature sensor is structured so that the absolute temperature of the surface of the heating roller can be grasped by detecting the voltages across the two thermistors disposed as described above, and converts the voltages across the two thermistors into digital values by an AD converter and outputs the digital values after the conversion to the CPU. The CPU obtains the surface temperature of the heating roller based on the inputted digital values and a predetermined table by executing a predetermined program, and controls the power supply to the heating roller.

However, there is a possibility that the software processing performed by the CPU cannot appropriately control the power supply to the heating roller when an anomaly occurs such as when the CPU cannot perform the predetermined processing because of an unexpected bug or the like and cannot respond within a predetermined time to cause a timeout or when the processing is stopped due to inability to continue the processing.

BRIEF SUMMARY

The technology disclosed herein is made in view of such circumstances, and an object thereof is to provide a fixing apparatus and an image forming apparatus having the fixing apparatus in which since the following are provided: a first sensor that detects the radiant heat from a heating roller; a second sensor that detects the ambient temperature of the first sensor; a computing circuit that computes a threshold value for determining whether the temperature of the heating roller is abnormal or not; and a controlling circuit that controls the operation condition of the heating roller based on the output values of the first sensor and the second sensor and the threshold value computed by the computing circuit, when the surface temperature of the heating roller becomes abnormal, even if the control by software processing such as control by the CPU is disabled, the power supply to the heating roller can be reliably controlled by a hardware structure.

The technology disclosed herein further provides a fixing apparatus and an image forming apparatus having the fixing apparatus in which since the heating of the heating roller is stopped when the difference value between the output values of the first sensor and the second sensor is equal to or higher than the threshold value, when the surface temperature of the heating roller becomes abnormal, the power supply to the heating roller can be forcibly stopped by a hardware structure.

The technology disclosed herein further provides a fixing apparatus and an image forming apparatus having the fixing apparatus in which since the computing circuit computes the threshold value based on the output value of the second sensor, the threshold value can be varied according to the output value of the second sensor and anomaly in the surface temperature of the heating roller can be detected with a simpler structure than when a plurality of fixed threshold values are provided.

The technology disclosed herein further provides a fixing apparatus and an image forming apparatus having the fixing apparatus in which since the computing circuit is provided with: an amplifying circuit that amplifies the output value of the second sensor; and an adding and subtracting circuit that adds and subtracts a required numerical value to and from the output value amplified by the amplifying circuit and the output value of the adding and subtracting circuit is set as the threshold value, the required threshold value can be set according to the output value of the second sensor with a simple structure.

The technology disclosed herein further provides a fixing apparatus and an image forming apparatus having the fixing apparatus in which since the following are provided: a plurality of amplifying circuits having different amplification factors; a plurality of adding and subtracting circuits having different addends and subtrahends; and a detecting circuit that detects in which of a plurality of predetermined output ranges the output value of the second sensor is and the computing circuit has the amplifying circuit and the adding and subtracting circuit for each of the output ranges, anomaly in the surface temperature of the heating roller can be detected over a wider range of the output value of the second sensor than the conventional range.

The technology disclosed herein further provides a fixing apparatus and an image forming apparatus having the fixing apparatus in which since the detecting circuit detects in which of at least three output ranges the output value of the second sensor is, anomaly in the surface temperature of the heating roller can be detected with a simple structure according to the detected temperature characteristics of the first sensor and the second sensor.

The present technology disclosed herein further provides a fixing apparatus and an image forming apparatus having the fixing apparatus in which since a switch is provided for stopping the power supply to the heating roller when the difference value is equal to or higher than the threshold value, the excessive temperature rise of the heating roller can be prevented by a hardware structure.

A fixing apparatus according to an example embodiment comprises a heating roller, and heats a sheet where an image by a developer has been transferred, to thereby fix the image on the sheet, and is provided with: a first sensor that detects the radiant heat from the heating roller; a second sensor that detects the ambient temperature of the first sensor; a computing circuit that computes a threshold value for determining whether the temperature of the heating roller is abnormal or not; and a controlling circuit that controls the operation condition of the heating roller based on the output values of the first sensor and the second sensor and the threshold value computed by the computing circuit.

The fixing apparatus according to an example embodiment is further provided with: a calculating circuit that calculates the difference value between the output values of the first sensor and the second sensor; and a comparing circuit that compares the difference value calculated by the calculating circuit with the threshold value, and the controlling circuit stops the heating of the heating roller when the difference value is equal to or higher than the threshold value.

In the fixing apparatus according to an example embodiment the computing circuit computes the threshold value based on the output value of the second sensor.

In the fixing apparatus according to an example embodiment the computing circuit is provided with: an amplifying circuit that amplifies the output value of the second sensor; and an adding and subtracting circuit that adds and subtracts a required numerical value to and from the output value amplified by the amplifying circuit, and the output value of the adding and subtracting circuit is set as the threshold value.

The fixing apparatus according to an example embodiment comprises: a plurality of amplifying circuits having different amplification factors; a plurality of adding and subtracting circuits having different addends and subtrahends; and a detecting circuit that detects in which of a plurality of predetermined output ranges the output value of the second sensor is, and the computing circuit has the amplifying circuit and the adding and subtracting circuit for each of the output ranges.

In the fixing apparatus according to an example embodiment the detecting circuit detects in which of at least three output ranges the output value of the second sensor is.

In the fixing apparatus according to an example embodiment the heating roller is structured so as to emit heat by being supplied with power; and the controlling circuit has a switch for stopping the power supply when the difference value is equal to or higher than the threshold value.

An image forming apparatus according to an example embodiment comprises: a transferring device that transfers an image by a developer onto a sheet based on obtained image data; and the fixing apparatus according to any one of the technology disclosed hereins mentioned above, and the image is fixed by the fixing apparatus to perform image formation.

According to the an example embodiment, the computing circuit computes the threshold value for determining whether the temperature of the heating roller is abnormal or not, and the controlling circuit controls the operation condition of the heating roller based on the output values of the first sensor (infrared detecting thermistor) and the second sensor (compensating thermistor) and the threshold value computed by the computing circuit. For example, when the surface temperature of the heating roller becomes abnormal, the controlling circuit structured by means of hardware controls the operation of the heating roller to prevent the excessive temperature rise of the heating roller.

According to the an example embodiment the calculating circuit calculates the difference value between the output values of the first sensor and the second sensor, and the comparing circuit compares the difference value calculated by the calculating circuit with the threshold value. The controlling circuit stops the heating of the heating roller when the difference value is equal to or higher than the threshold value. Thereby, determining that the surface temperature of the heating roller is abnormal, the controlling circuit stops the heating of the heating roller when the difference value is equal to or higher than the threshold value.

According to the an example embodiment the computing circuit computes the threshold value based on the output value of the second sensor. For example, the computing circuit computes the threshold value so as to vary according to the change of the output value of the second sensor when the output value changes. Thereby, it is unnecessary to previously hold a plurality of fixed threshold values for determining anomaly in the surface temperature of the heating roller, and the required threshold value is computed only by the computing circuit.

According to an example embodiment the computing circuit is provided with an amplifying circuit and an adding and subtracting circuit. The amplifying circuit (positively or negatively) amplifies the output value of the second sensor. The adding and subtracting circuit adds and subtracts a required value to and from the output value amplified by the amplifying circuit, and sets the result as the threshold value. Thereby, the computing circuit computes the threshold value represented by a straight line having a required inclination and intercept with the output value of the second sensor as the input parameter.

According to an example embodiment the following are provided: a plurality of amplifying circuits having different amplification factors; a plurality of adding and subtracting circuits having different addends and subtrahends; and a detecting circuit that detects in which of a plurality of predetermined output ranges the output value of the second sensor is. The computing circuit has the amplifying circuit and the adding and subtracting circuit for each of the output ranges. Thereby, the computing circuit computes the threshold value represented by a straight line having a different inclination and intercept for each section over a wide range of the output value of the second sensor with the output value of the second sensor as the input parameter.

According to an example embodiment the detecting circuit detects in which of at least three output ranges the output value of the second sensor is.

According to an example embodiment, when the difference value is equal to or higher than the threshold value, the switch structured by means of hardware stops the power supply to the heating roller to thereby prevent the excessive temperature rise.

The technology disclosed herein is applicable to fixing apparatus provided in image forming apparatuses such as printers and digital multifunction apparatuses.

According to an example embodiment the following are provided: the first sensor that detects the radiant heat from the heating roller; the second sensor that detects the ambient temperature of the first sensor; the computing circuit that computes the threshold value for determining whether the temperature of the heating roller is abnormal or not; and the controlling circuit that controls the operation condition of the heating roller based on the output values of the first sensor and the second sensor and the threshold value computed by the computing circuit, when the surface temperature of the heating roller becomes abnormal, even if the control by software processing such as control by the CPU is disabled, the excessive temperature rise of the heating roller can be prevented by reliably controlling the power supply to the heating roller by means of hardware, so that safety can be improved.

According to an example embodiment, since the controlling circuit stops the heating of the heating roller when the difference value between the output values of the first sensor and the second sensor is equal to or higher than the threshold value, when the surface temperature of the heating roller becomes abnormal, the excessive temperature rise of the heating roller can be prevented by forcibly stopping the power supply to the heating roller by a hardware structure.

According to an example embodiment, since the computing circuit computes the threshold value based on the output value of the second sensor, the threshold value can be varied according to the output value of the second sensor, and anomaly in the surface temperature of the heating roller can be detected with a simpler structure than when a plurality of fixed threshold values are provided.

According to an example embodiment, since the computing circuit is provided with: an amplifying circuit that amplifies the output value of the second sensor; and an adding and subtracting circuit that adds and subtracts a required numerical value to and from the output value amplified by the amplifying circuit and the output value of the adding and subtracting circuit is set as the threshold value, the required threshold value can be set according to the output value of the second sensor with a simple structure.

According to an example embodiment, since the following are provided: a plurality of amplifying circuits having different amplification factors; a plurality of adding and subtracting circuits having different addends and subtrahends; and a detecting circuit that detects in which of a plurality of predetermined output ranges the output value of the second sensor is and the computing circuit has the amplifying circuit and the adding and subtracting circuit for each of the output ranges, anomaly in the surface temperature of the heating roller can be detected over a wider range of the output value of the second sensor than the conventional range.

According to an example embodiment, since the detecting circuit detects in which of at least three output ranges the output value of the second sensor is, anomaly in the surface temperature of the heating roller can be detected with a simple structure according to the detected temperature characteristics of the first sensor and the second sensor.

According to an example embodiment, since a switch is provided for stopping the power supply to the heating roller when the difference value is equal to or higher than the threshold value, the excessive temperature rise of the heating roller can be prevented by a hardware structure.

The technology disclosed herein is applicable to fixing apparatus provided in image forming apparatuses such as printers and digital multifunction apparatuses.

The above and further features of the technology disclosed herein will more fully be apparent from the following detailed description with accompanying drawings.

DETAILED DESCRIPTION

Figure 1:
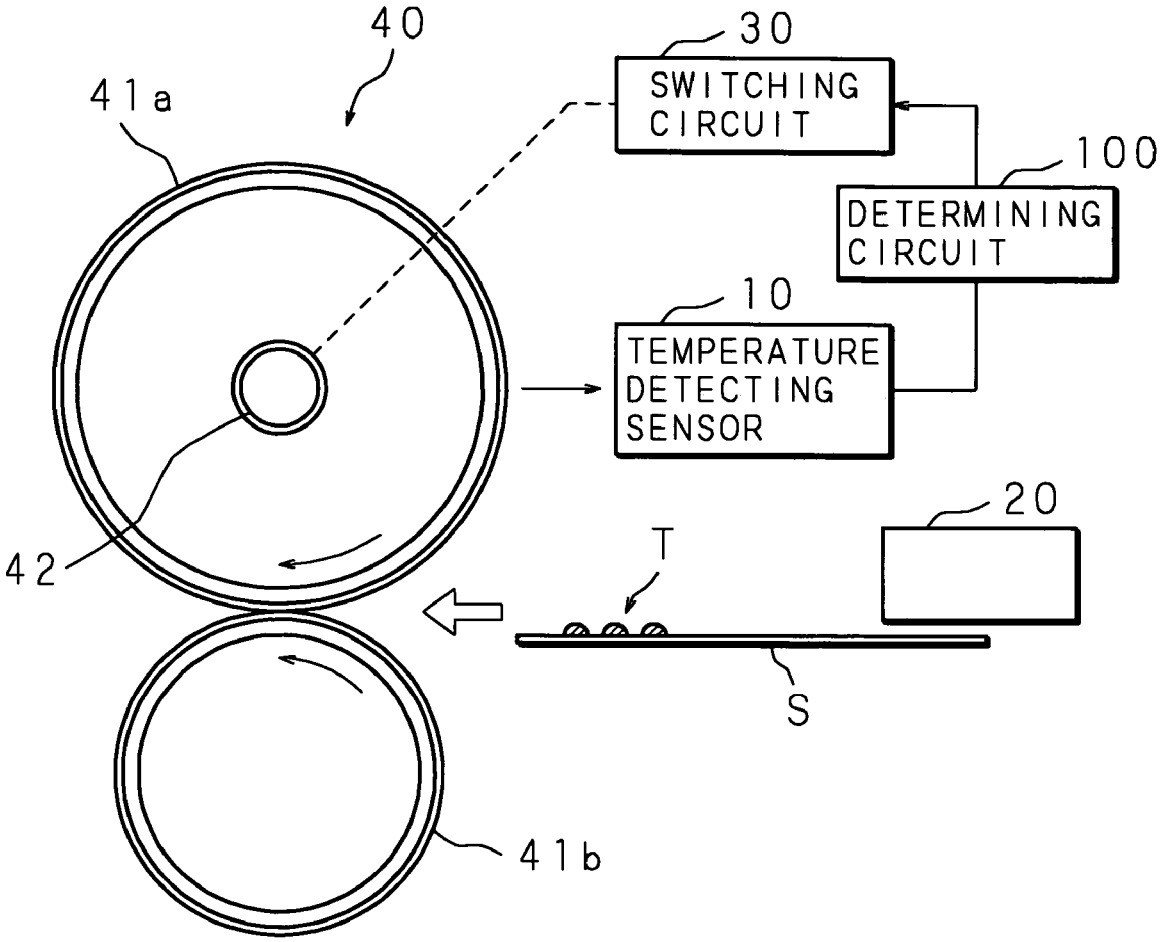
FIG. 1 is a schematic view showing the structure of a relevant part of a digital multifunction apparatus according to an example embodiment.

A digital multifunction apparatus as an example of a fixing apparatus according to the technology disclosed herein and an image forming apparatus having the fixing apparatus will be described based on the drawings showing an embodiment. FIG. 1 is a schematic view showing the structure of a relevant part of the digital multifunction apparatus according to an example embodiment. The digital multifunction apparatus performs image formation by electrophotography, and an image by a developer (toner image T) is transferred onto a sheet S such as a recording sheet or an OHP film by a transferring device 20. The sheet S where the toner image T has been transferred is conveyed along a predetermined conveyance path, and when the sheet S passes through a fixing apparatus 40, the toner image T is fixed on the sheet S by the action of a heating roller 41*a* and a pressure roller 41*b*. The sheet S where the toner image T is fixed is further conveyed along a predetermined conveyance path, and ejected to the outside of the apparatus.

The fixing apparatus 40 includes the heating roller 41*a*, the pressure roller 41*b*, a heater 42, a temperature detecting sensor 10 that detects the surface temperature of the heating roller 41*a*, a determining circuit 100 that determines whether the surface temperature of the heating roller 41*a* is abnormal or not, and a switching circuit 30 having a switch for shutting off the power supply to the heater 42.

The heating roller 41*a* comprises a hollow cylindrical metal core and a release layer formed outside the metal core. The metal core is made of a metal such as iron, stainless steel, aluminum or copper, or an alloy thereof, and is, for example, approximately 40 mm in diameter and approximately 1.3 mm in wall thickness. The release layer is formed by applying to the metal core a fluoride resin such as PTA (copolymer of tetrafluoroethylene and perfluoroalkylvinylether) or PTFE (polytetrafluoroethylene) or a synthetic resin such as silicone rubber or fluoric rubber. The thickness of the release layer is, for example, approximately 25 μm.

The heater 42 as the heating means is provided inside the heating roller 41*a*. As the heater 42, for example, a bar-shaped halogen lamp may be used. The heater 42 emits light by externally receiving power supply, and emits infrared rays. The inner surface of the heating roller 41*a* (that is, the inner surface of the metal core) is heated by the infrared rays emitted from the heater 42. The fixing apparatus 40 maintains the surface temperature of the heating roller 41*a* substantially constant by controlling the on and off of the heater 42.

The pressure roller 41*b* is disposed on the opposite side of the heating roller 41*a* with the conveyance path of the sheet S in between so as to abut on the heating roller 41*a*. The pressure roller 41*b* comprises a hollow cylindrical metal core, a heat-resistant elastic material layer formed outside the metal core, and a release layer formed outside the metal core. The metal core and the release layer are made of the same materials as the metal core and the release layer used for the heating roller 41*a*. The heat-resistant elastic material layer for which silicone rubber or the like is used is, for example, formed outside the metal core with a thickness of approximately 6 mm. To the pressure roller 41*b*, a pressing force of a predetermined magnitude is applied in the direction of the heating roller 41*a* by a pressing member such as a spring for pressurization (not shown), so that a fixing nip with a width of approximately 6 mm is formed in the part where the heating roller 41*a* and the pressure roller 41*b* are pressed against each other.

Figure 2:
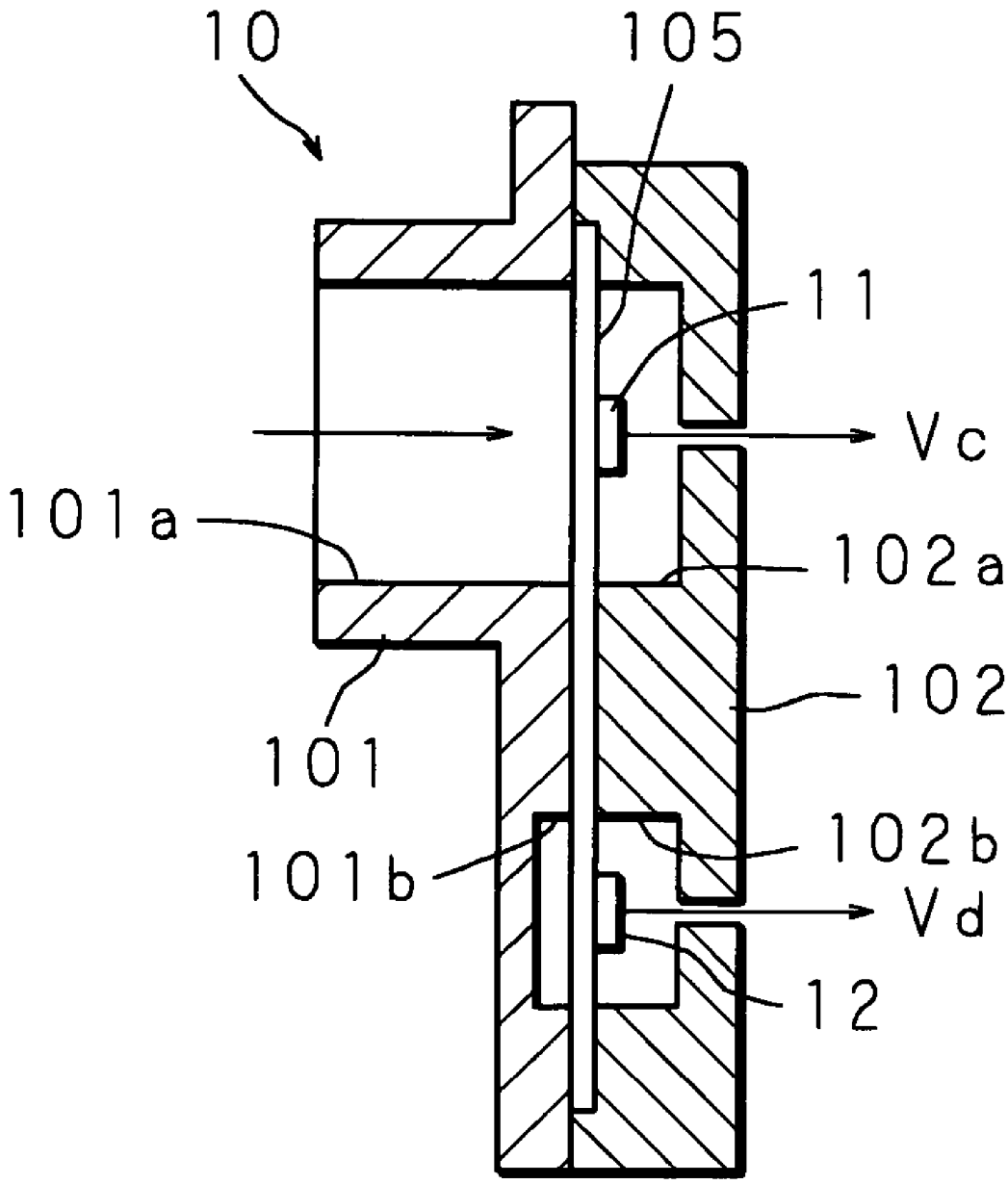
FIG. 2 is a cross-sectional view showing the structure of a temperature detecting sensor.

The temperature detecting sensor 10 is a noncontact-type temperature sensor that detects the radiant heat (infrared rays) from the surface of the heating roller 41*a*. The structure thereof will be described in the following: FIG. 2 is a cross-sectional view showing the structure of the temperature detecting sensor 10. The temperature detecting sensor 10 has an infrared detecting thermistor 11 and a compensating thermistor 12 inside the casing thereof. The casing of the temperature detecting sensor 10 comprises a holding member 101 and a lid member 102. The holding member 101 and the lid member 102 are made of a metal such as aluminum that is high in thermal conductivity and low in thermal emissivity.

The holding member 101 has an opening 101*a* for passing the infrared rays emitted from the heating roller 41*a*. A concave portion 101*b* is provided at an appropriate distance from the opening 101*a*. The lid member 102 is fixed to the holding member 101 with an infrared absorbing film 105 sandwiched therebetween. As the infrared absorbing film 105, for example, a black absorbing film may be used. The lid member 102 has a space 102*a* provided so as to be opposed to the opening 101*a* of the holding member 101 and a space 102*b* provided so as to be opposed to the concave portion 101*b*.

The infrared detecting thermistor 11 is placed on the infrared absorbing film 105 in the space defined by the infrared absorbing film 105 and the space 102*a* of the lid member 102. The compensating thermistor 12 is placed on the infrared absorbing film 105 in the space defined by the infrared absorbing film 105 and the space 102*b* of the lid member 102.

When the infrared rays from the heating roller 41*a* are incident on the infrared absorbing film 105 through the opening 101*a*, the infrared rays are absorbed by the infrared absorbing film 105. The infrared absorbing film 105 rises in temperature according to the amount of absorbed infrared rays. The temperature of the infrared absorbing film 105 is detected as the voltage Vc across the infrared detecting thermistor 11 placed on the infrared absorbing film 105. Here, since the infrared detecting thermistor 11 is influenced by the temperature environment of the surroundings (for example, the holding member 101 and the lid member 102), to detect the surface temperature of the heating roller 41*a*, it is necessary to remove the influence. Therefore, the compensating thermistor 12 is placed at a location not directly affected by the infrared rays emitted from the heating roller 41*a*, and by detecting the voltage Vd across the compensating thermistor 12, the infrared detecting thermistor 11 is compensated for. In the fixing apparatus 40, the surface temperature of the heating roller 41*a* can be detected based on the output of the temperature detecting sensor 10.

Figure 3:
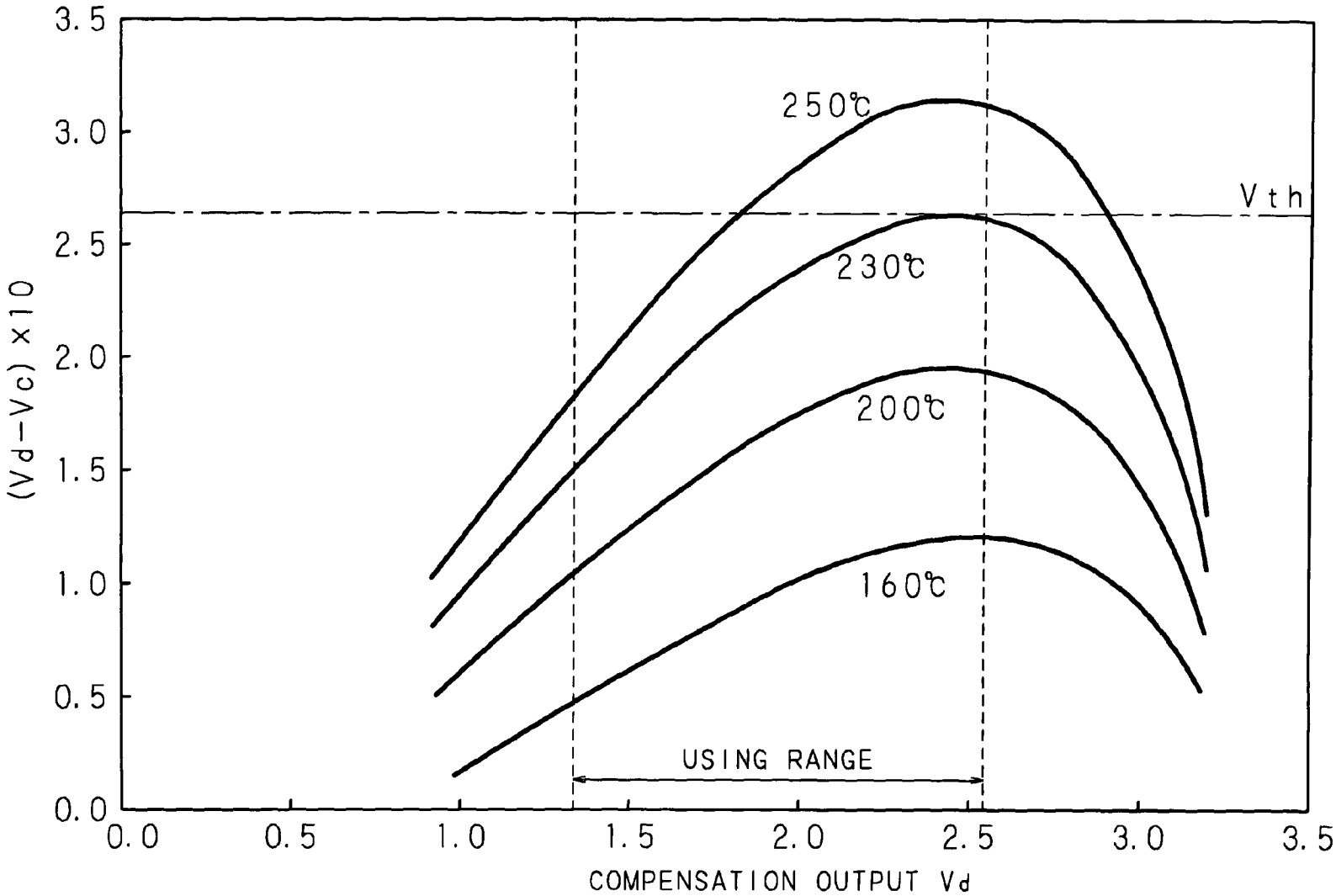
FIG. 3 is a graph showing the relation between the output of the temperature detecting sensor and the surface temperature of a heating roller.

FIG. 3 is a graph showing the relation between the output of the temperature detecting sensor 10 and the surface temperature of the heating roller 41*a*. The lateral axis of the graph represents the compensation output Vd which is the output voltage of the compensating thermistor 12, and the longitudinal axis thereof represents a value that is ten times the difference value between the compensation output Vd and the sensor output Vc which is the output voltage of the infrared detecting thermistor 11 (hereinafter, this value will be referred to as difference output). As shown in the figure, the surface temperature of the heating roller 41*a* can be obtained by detecting the compensation output Vd and the difference output (Vd−Vc)×10. For example, when the compensation output is 2.5 V and the difference output is 1.2 V, the surface temperature of the heating roller 41*a* is 160° C. Likewise, when the compensation output is 2.5 V, the surface temperature of the heating roller 41*a* is 200° C. when the difference output is 1.9 V, the surface temperature of the heating roller 41*a* is 230° C. when the difference output is 2.6 V, and the surface temperature of the heating roller 41*a* is 250° C. when the difference output is 3.1 V Therefore, a table where the relation among the compensation output Vd, the difference output (Vd−Vc)×10 and the surface temperature is converted into numerical values is held and the applicable surface temperature is read from the table when the compensation output Vd and the difference output (Vd−Vc)×10 are detected, whereby the surface temperature of the heating roller 41*a* can be obtained.

A threshold value Vth can be set with respect to the value of the difference output in order that the surface temperature of the heating roller 41*a* does not become equal to or higher than a predetermined temperature. For example, when it is required that the surface temperature of the heating roller 41*a* be equal to or lower than 250° C., the threshold value Vth is set to 2.63 V. It is apparent that when the difference output (Vd−Vc)×10 is equal to or lower than 2.63 V, the surface temperature of the heating roller 41*a* does not exceed 250° C. as long as the compensation output Vd is within a predetermined range. Therefore, the difference output (Vd−Vc)×10 is compared with the threshold value Vth, and when the difference output (Vd−Vc)×10 is higher than the threshold value Vth, the switching circuit 30 is controlled to stop the power supply to the heater 42, whereby the excessive temperature rise of the heating roller 41*a* can be prevented.

Figure 4:
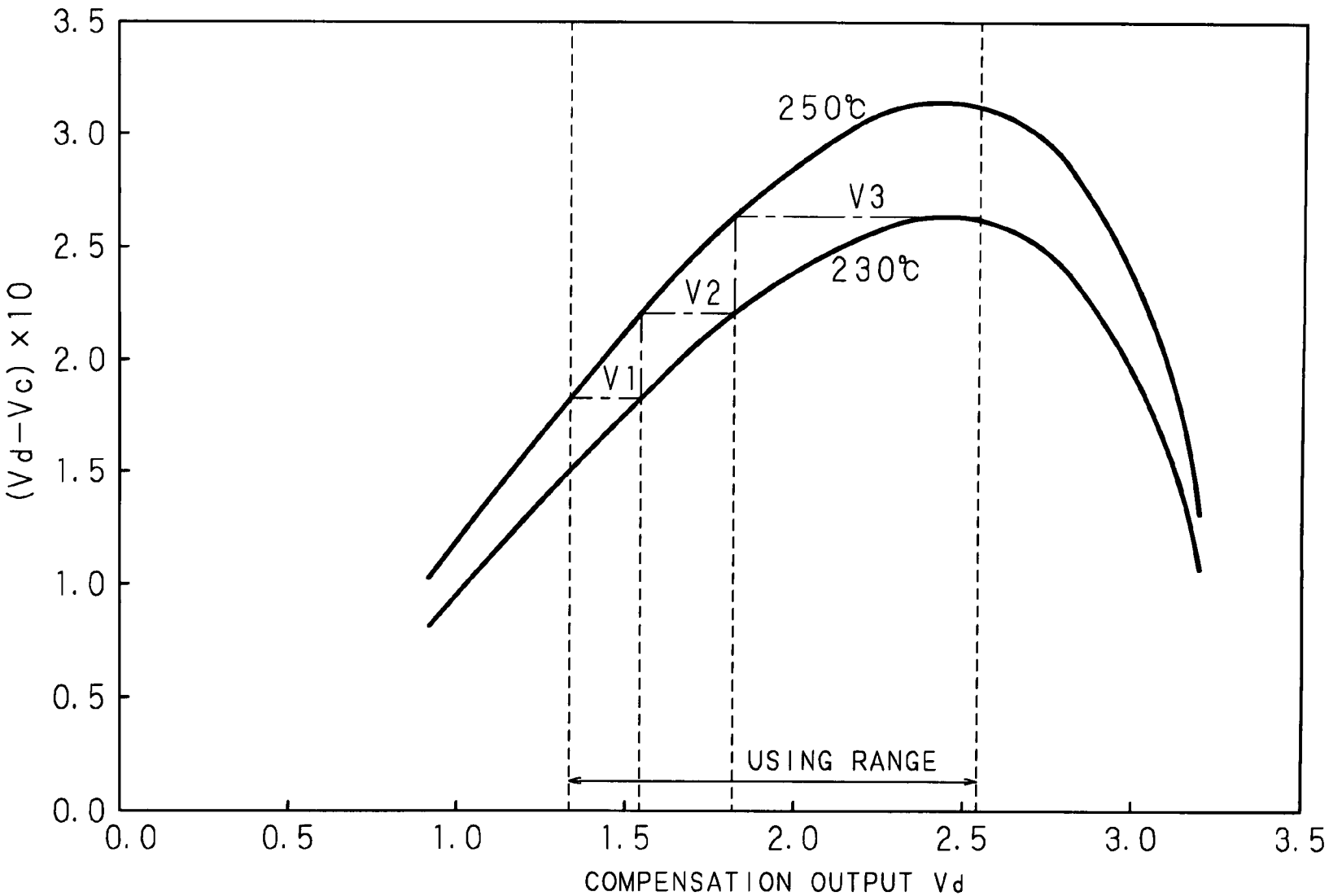
FIG. 4 is a graph for explaining a case where a plurality of fixed threshold values are set.

FIG. 4 is a graph for explaining a case where a plurality of fixed threshold values are set. The lateral axis of the graph represents the compensation output Vd which is the output voltage of the compensating thermistor 12, and the longitudinal axis thereof represents a value that is ten times the difference between the compensation output Vd and the sensor output Vc which is the output voltage of the infrared detecting thermistor 11 (hereinafter, this value will be referred to as difference output). For example, when it is required that the surface temperature of the heating roller 41*a* be equal to or lower than 250° C., the threshold value V1 is set to 1.8 V when the compensation output Vd is in a range of 1.35 to 1.6 V, the threshold value V2 is set to 2.2 V when the compensation output Vd is in a range of 1.6 to 1.8 V, and the threshold value V3 is set to 265 V when the compensation output Vd is in a range of 1.8 to 2.6 V. Thereby, it can be determined whether the surface temperature of the heating roller 41*a* is higher than 250° C. or not when the compensation output Vd is in a range of 1.35 to 2.6 V (using range).

However, when the threshold value Vth is set with respect to the difference output (Vd−Vc)×10, the using range of the compensation output Vd is limited to the range of 1.35 to 2.6 V, and for a wider range (0.9 to 3.0 V), the surface temperature of the heating roller 41*a* cannot be detected. To enable the use when the compensation output is in the range of 0.9 to 3.0 V, it will be necessary to stepwisely set a multiplicity of (at least ten) threshold values Vt along the temperature characteristic curve of a surface temperature of 250° C., so that the determining circuit will be complicated and large in scale.

To cope with this problem, instead of providing a multiplicity of threshold values Vth, a predetermined computation is performed by using the value of the computation output Vd, and the result of the computation is used as the threshold value.

Figure 5:
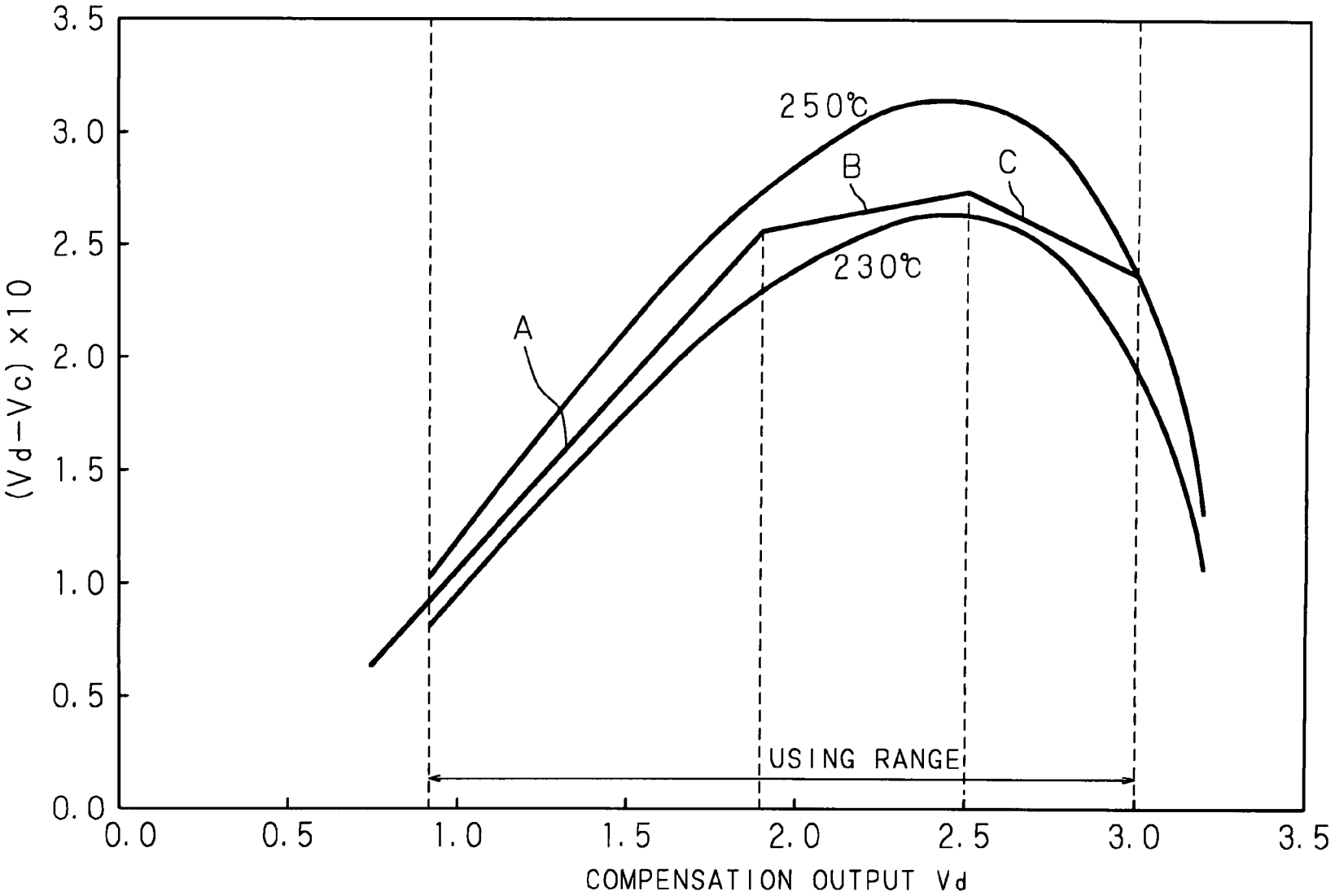
FIG. 5 is a graph for explaining the threshold value set in an example embodiment.

FIG. 5 is a graph for explaining the threshold value set in the example embodiment. The lateral axis of the graph represents the compensation output Vd which is the output voltage of the compensating thermistor 12, and the longitudinal axis thereof represents a value that is ten times the difference value between the compensation output Vd and the sensor output Vc which is the output voltage of the infrared detecting thermistor 11 (hereinafter, this value will be referred to as difference output). In the figure, the straight lines A, B and C are threshold lines obtained by a predetermined computation according to the compensation output Vd. Thereby, the threshold value can be made to vary according to the change of the compensation output Vd, and can be set, for example, so as to be close to the temperature curve of 250° C. By making the threshold lines close to the temperature curve of 250° C., anomaly in the surface temperature of the heating roller 41*a* can be accurately detected.

In the figure, for the threshold line A, the line inclination is 1.58, and the intercept on the longitudinal axis (difference output) is −0.5. For the threshold line B, the line inclination is 0.48, and the intercept on the longitudinal axis (difference output) is 1.6. For the threshold line C, the line inclination is −1.20, and the intercept on the longitudinal axis (difference output) is 5.9. It is apparent that by doing this, the threshold lines A, B and C are present between the characteristic curve of the surface temperature of 250° C. and the characteristic curve of the surface temperature of 230° C. and can be set close to the temperature curve of 250° C. and in the wide using range of the compensation output Vd from 0.9 to 3.0 V, the surface temperature of the heating roller 41*a* does not exceed 250° C. unless the compensation output Vd exceeds the threshold value. Since the threshold value can be set so as to vary along the characteristic curve of the surface temperature, anomaly in the surface temperature of the heating roller 41*a* can be detected more accurately than when fixed threshold values are set as has conventionally been done.

Figure 6:
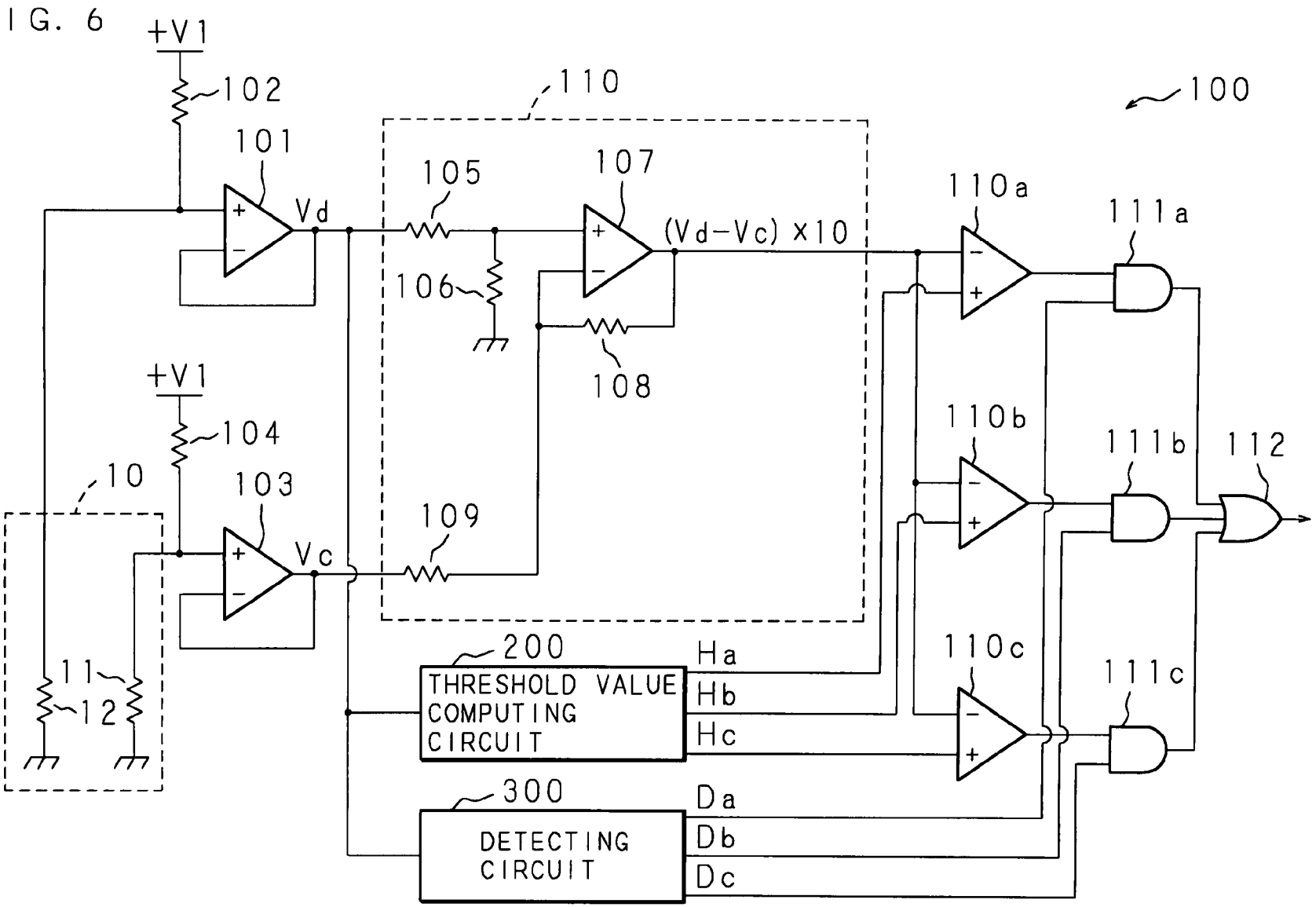
FIG. 6 is a circuit diagram showing an example of a determining circuit.

Next, the determining circuit 100 for realizing the threshold value shown in FIG. 5 will be concretely described. FIG. 6 is a circuit diagram showing an example of the determining circuit 100. The output voltage (sensor output Vc) of the infrared detecting thermistor 11 is extracted by a voltage follower circuit 103 comprising an operational amplifier. Likewise, a resistor 102 is serially connected to the compensating thermistor 12, and the output voltage (compensation output Vd) of the compensating thermistor 12 is extracted by a voltage follower circuit 101 comprising an operational amplifier.

The sensor output Vc by the infrared detecting thermistor 11 and the compensation output Vd by the compensating thermistor 12 are inputted to a differential amplifier circuit 110 comprising an operational amplifier 107 and resistors 105, 106, 108 and 109. The resistance values of the resistors 105 and 109 are, for example, 10 kΩ, and the resistance values of the resistors 106 and 108 are 100 kΩ. Thereby, the differential amplifier circuit 110 amplifies the difference (Vd−Vc) between the compensation output Vd and the sensor output Vc tenfold, and outputs the difference output (Vd−Vc)×10.

The compensation output Vd extracted by the voltage follower circuit 101 is inputted to a threshold value computing circuit 200 and a detecting circuit 300. The threshold value computing circuit 200 has three amplifying circuits and adding and subtracting circuits as mentioned later, and outputs threshold values as the computation results from output terminals Ha, Hb and Hc. First, the threshold value computing circuit 200 calculates a threshold value 1.58×Vd−0.5 based on the compensation output Vd, and outputs it from the output terminal Ha. Moreover, the threshold value computing circuit 200 calculates a threshold value 0.48×Vd+1.6 based on the compensation output Vd, outputs it from the output terminal Hb, calculates a threshold value −1.2×Vd+5.9, and outputs it from the output terminal Hc.

The detecting circuit 300 has a comparator and the like as mentioned later, and outputs a high-level signal from one of output terminals Da, Db and Dc according to the inputted compensation output Vd. More specifically, when the compensation output Vd is lower than 1.9 V, a high-level signal is outputted from the output terminal Ha, and low-level signals are outputted from the output terminals Hb and Hc. When the compensation output Vd is equal to or higher than 1.9 V and lower than 2.5 V, a high-level signal is outputted from the output terminal Hb, and low-level signals are outputted from the output terminals Ha and Hc. When the compensation output Vd is equal to or higher than 2.5 V, a high-level signal is outputted from the output terminal Hc, and low-level signals are outputted from the output terminals Ha and Hb.

The difference output (Vd−Vc)×10 outputted from the differential amplifier circuit 110 is inputted to the (−) terminals of comparators 110*a*, 110*b* and 110*c*. To the (+) terminal of the comparator 110*a*, the threshold value 1.58×Vd−0.5 from the threshold value computing circuit 200 is inputted. To the (+) terminal of the comparator 110*b*, the threshold value 0.48×Vd+1.6 from the threshold value computing circuit 200 is inputted. To the (+) terminal of the comparator 110*c*, the threshold value −1.2×Vd+5.9 from the threshold value computing circuit 200 is inputted.

Thereby, the comparator 110*a* outputs a high-level signal to an AND circuit 111*a* when the difference output (Vd−Vc)×10 is higher than the threshold value 1.58×Vd−0.5. Likewise, the comparator 110*b* outputs a high-level signal to an AND circuit 111*b* when the difference output (Vd−Vc)×10 is higher than the threshold value 0.48×Vd+1.6, and the comparator 110*c* outputs a high-level signal to an AND circuit 111*c* when the difference output (Vd−Vc)×10 is higher than the threshold value −1.2×Vd+5.9.

The output terminals Da, Db and Dc of the detecting circuit 300 are connected to the AND circuits 111*a*, 111*b* and 111*c*, respectively, and the outputs of the AND circuits 111*a*, 111*b* and 111*c* are inputted to an OR circuit 112.

Thereby, when the compensation output Vd is lower than 1.9 V and the difference output (Vd−Vc)×10 is higher than the threshold value 1.58×Vd−0.5, it is determined that the surface temperature of the heating roller 41*a* is abnormal, and an anomaly determination output is outputted from the OR circuit 112 as a high-level signal. Likewise, when the compensation output Vd is equal to or higher than 1.9 V and lower than 2.5 V and the difference output (Vd−Vc)×10 is higher than the threshold value 0.48×Vd+1.6, it is determined that the surface temperature of the heating roller 41*a* is abnormal and an anomaly determination output is outputted from the OR circuit 112 as a high-level signal, and when the compensation output Vd is higher than 2.5 V and the difference output (Vd−Vc)×10 is higher than the threshold value −1.2×Vd+5.9, it is determined that the surface temperature of the heating roller 41*a* is abnormal and an anomaly determination output is outputted from the OR circuit 112 as a high-level signal.

Figure 7:
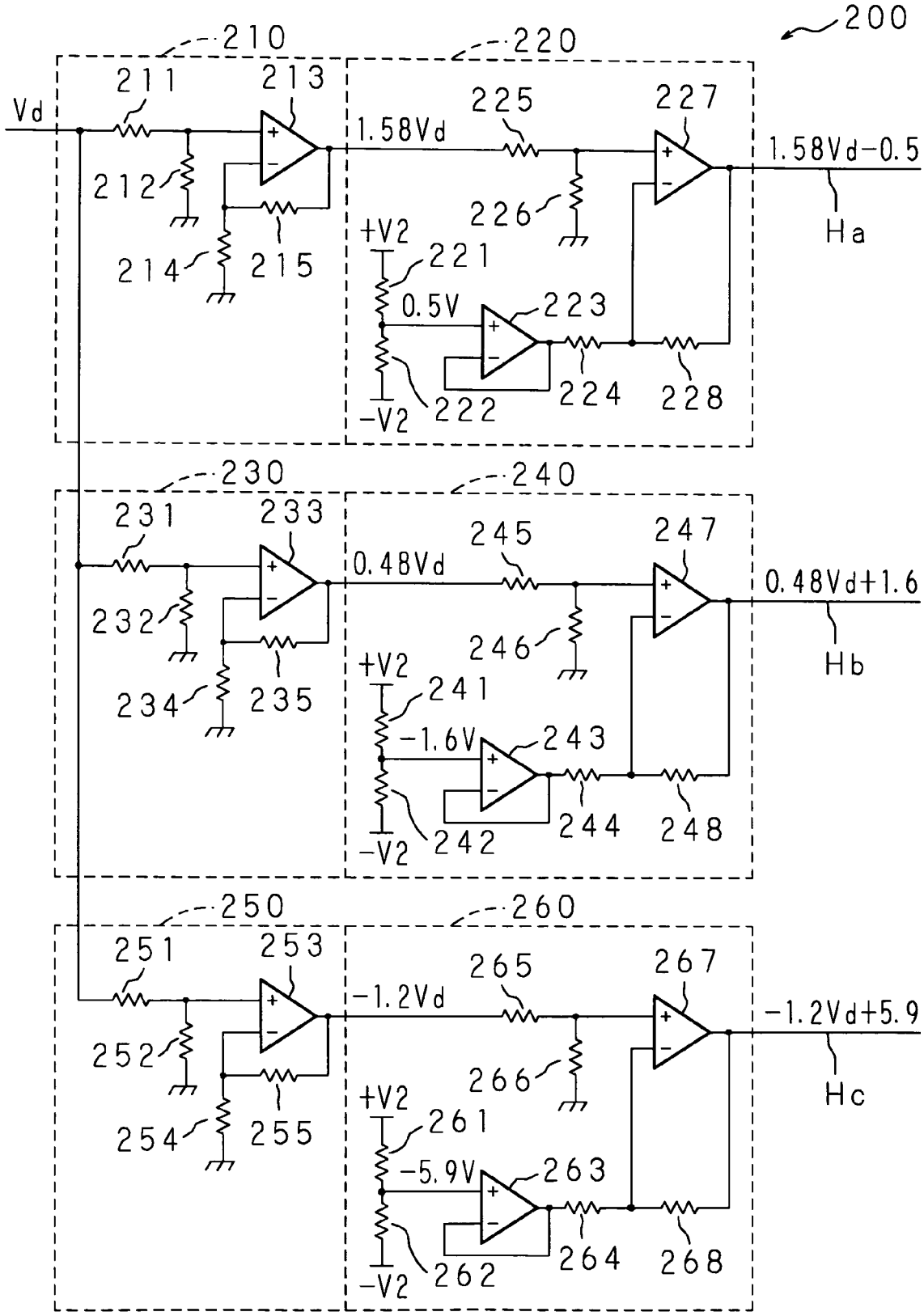
FIG. 7 is a circuit diagram showing an example of a threshold value computing circuit.

FIG. 7 is a circuit diagram showing an example of the threshold value computing circuit 200. The threshold value computing circuit 200 includes amplifying circuits 210, 230 and 250 having different amplification factors and adding and subtracting circuits 220, 240 and 260 having different addends and subtrahends. The compensation output Vd extracted by the voltage follower circuit 101 is inputted to the amplifying circuits 210, 230 and 250. The adding and subtracting circuits 220, 240 and 260 output the threshold values 1.58×Vd−0.5, 0.48×Vd+1.6 and −1.2×Vd+5.9, respectively.

The amplifying circuit 210 includes resistors 211, 212, 214, and 215, and an operational amplifier 213. Here, the resistance values of the resistors 211 and 214 are, for example, 10 kΩ, and the resistance values of the resistors 212 and 215 are 15.8 kΩ. Thereby, a voltage of 158 Vd is outputted to the output of the operational amplifier 213.

The adding and subtracting circuit 220 subtracts 0.5 V from the voltage of 1.58 Vd outputted from the amplifying circuit 210, and outputs the threshold value 1.58 Vd−0.5 from the terminal Ha. The adding and subtracting circuit 220 includes resistors 221 and 222 for generating the voltage of 0.5 V, a voltage follower circuit 223, resistors 224 to 226 and 228, and an operational amplifier 227. The resistance value of the resistor 221 is, for example, 9.5 kΩ, and the resistance value of the resistor 222 is 10.5 kΩ. The resistance values of the resistors 224 to 226 and 228 are 10 kΩ.

Since the structure of the amplifying circuits 230 and 250 is similar to that of the amplifying circuit 210 and the structure of the adding and subtracting circuits 240 and 260 is similar to that of the adding and subtracting circuit 220, descriptions thereof are omitted.

Figure 8:
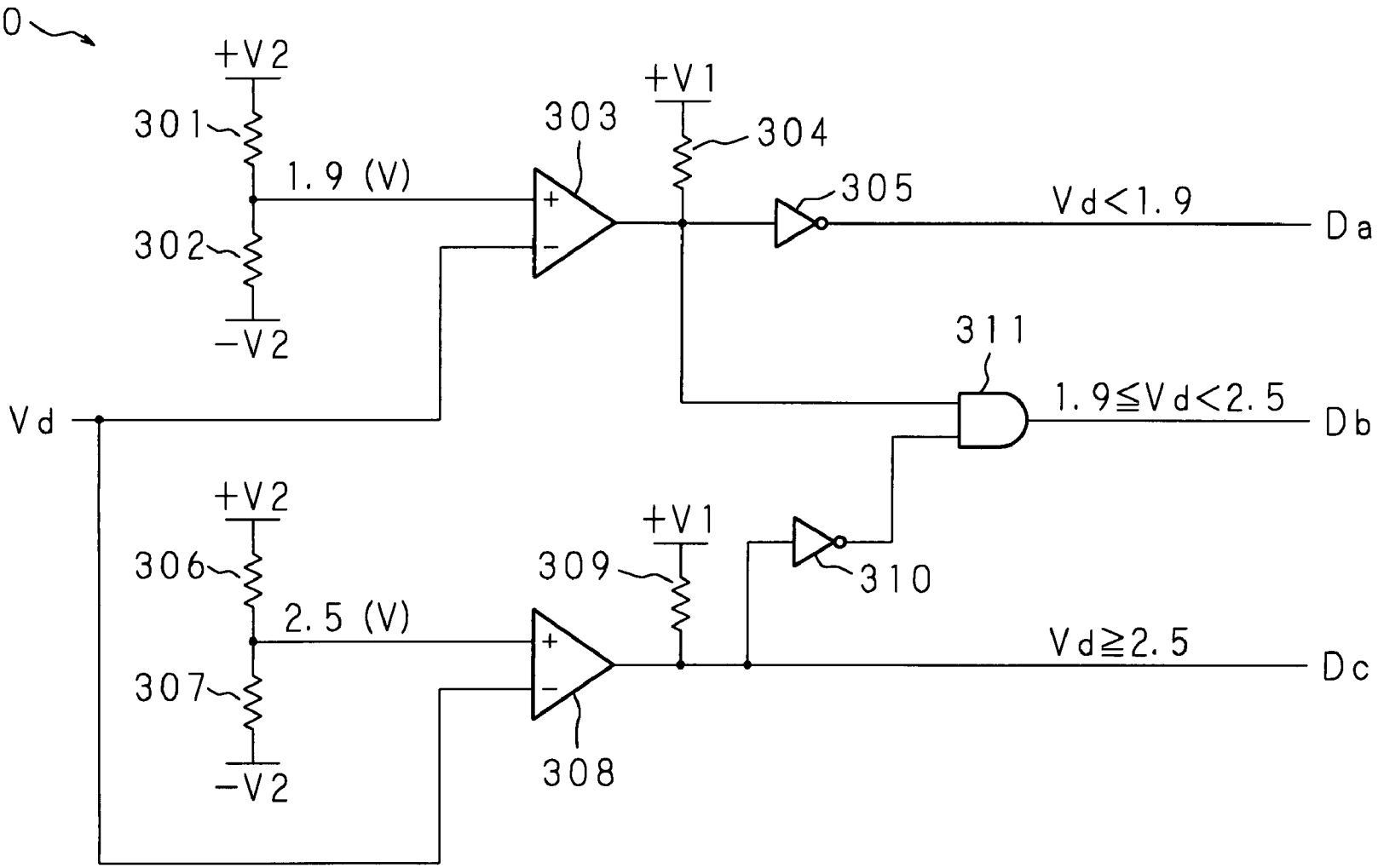
FIG. 8 is a circuit diagram showing an example of a detecting circuit.

FIG. 8 is a circuit diagram showing an example of the detecting circuit 300. The detecting circuit 300 divides the output range of the compensation output Vd into three ranges, and outputs a high-level signal from one of the three output terminals Da, Db and Dc according to the value of the compensation output Vd. In this case, the using range of the compensation output Vd (0.9 to 3.0 V) is divided into three ranges with 1.9 V and 2.5 V as the boundary values. The detecting circuit 300 includes resistors 301 and 302 for generating the 1.9 V as the boundary value, resistors 306 and 307 for generating the boundary value 2.5 V, comparators 303 and 308, inverter circuits 305 and 310, and an AND circuit 311.

To the (+) terminal of the comparator 303, a voltage of 1.9 V is inputted, and to the (−) terminal thereof, the compensation output Vd is inputted. The comparator 302 outputs a high-level signal when the compensation output Vd is equal to or higher than 1.9 V. Thereby, the inverter circuit 305 outputs a high-level signal through the output terminal Da when the compensation output Vd is lower than 1.9 V.

To the (+) terminal of the comparator 308, a voltage of 2.5 V is inputted, and to the (−) terminal thereof, the compensation output Vd is inputted. The comparator 308 outputs a high-level signal to the output terminal Dc and the inverter circuit 310 when the compensation output Vd is equal to or higher than 2.5 V. Thereby, a high-level signal is outputted from the output terminal Dc when the compensation output Vd is equal to or higher than 2.5 V. Since the output of the comparator 303 and the output of the inverter circuit 310 are inputted to the AND circuit 311, the AND circuit 311 outputs a high-level signal through the output terminal Db when the compensation output Vd is equal to or higher than 1.9 V and lower than 2.5 V.

As described above, according to an example embodiment, since the following are provided: the infrared detecting thermistor and the compensating thermistor that detect the radiant heat from the heating roller; the computing circuit that computes the threshold value for determining whether the temperature of the heating roller is abnormal or not; and the controlling circuit that controls the operation condition of the heating means based on the difference output and the threshold value computed by the computing circuit, when the surface temperature of the heating roller becomes abnormal, even if the control by software processing such as control by the CPU is disabled, the excessive temperature rise of the heating roller can be prevented by reliably controlling the power supply to the heater by hardware, so that safety can be improved. In particular, when the difference output exceeds the threshold value, the excessive temperature rise of the heating roller can be prevented by forcibly stopping the power supply to the heater.

Moreover, since the computing circuit computes the threshold value according to the compensation output, the threshold value for determining anomaly in the surface temperature of the heating roller can be varied according to the compensation output, so that anomaly in the surface temperature of the heating roller can be detected with a simpler structure than when a plurality of fixed threshold values are provided. Moreover, since the computing circuit is provided with: the amplifying circuit that amplifies the compensation output; and the adding and subtracting circuit that adds and subtracts a required numerical value to and from the compensation output amplified by the amplifying circuit, a required threshold value can be set according to the compensation output with a simple structure. In particular, the threshold value can be varied so as to fit the characteristic curve of the surface temperature irrespective of the shape of the characteristic curve, so that the application range where anomaly in the surface temperature of the heating roller is detected is increased and anomaly in the surface temperature can be detected accurately.

Moreover, since the following are provided: a plurality of amplifying circuits having different amplification factors; a plurality of adding and subtracting circuits having different addends and subtrahends; and the detecting circuit that detects in which output range the compensation output is and the computing circuit has the amplifying circuit and the adding and subtracting circuit for each output range detected by the detecting circuit, anomaly in the surface temperature of the heating roller can be detected over a wider range of the compensation output than the conventional range and the device can be realized with a simpler structure than when a multiplicity of threshold values are individually set.

While in the above-described embodiment, the using range of the compensation output is divided into three ranges and the threshold value is computed for each range, the number of divisions is not limited to three; it may be four or larger, or may be two. The number of divisions may be set according to the temperature characteristic of the temperature detecting sensor.

In the above-described embodiment, the circuit structures and circuit numerical values of the threshold value computing circuit, the detecting circuit and the like are merely an example, and the present invention is not limited thereto. For example, instead of a single-stage amplifying circuit, a multistage amplifying circuit may be used.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A fixing apparatus comprising:

a heating roller;

a first sensor configured to detect radiant heat from the heating roller;

a second sensor configured to detect an ambient temperature of the first sensor;

a computing circuit configured to compute, on the basis of output values of the second sensor, second sensor output correlation threshold values indicated by a plurality of threshold lines each of which is set within a range between one temperature curve and another temperature curve among a plurality of temperature curves that previously show correlations between output values of the first sensor, output values of the second sensor, and surface temperatures of the heating roller;

a detecting circuit configured to detect a threshold line corresponding to the output values of the second sensor among the plurality of threshold lines;

a controlling circuit configured to control a temperature provided to the heating roller based on a comparison result between the second sensor output correlation threshold values computed by the computing circuit based on the threshold line detected by the detecting circuit and the output values of the second sensor; and a fixing unit configured to heat a sheet where an image by a developer has been transferred by the heating roller so as to fix the image on the sheet.

2. The fixing apparatus according to claim 1, further comprising:

a calculating circuit configured to calculate a difference value between the output values of the first sensor and the second sensor; and a comparing circuit configured to compare the calculated difference value with the second sensor output correlation threshold value computed by the computing circuit based on the threshold line detected by the detecting circuit, in order to obtain the comparison result, wherein the controlling circuit is configured to stop the heating of the heating roller when the difference value is equal to or higher than the second sensor output correlation threshold value computed by the computing circuit based on the threshold line detected by the detecting circuit.

3. The fixing apparatus according to claim 1, wherein the computing circuit comprises:

an amplifying circuit configured to amplify the output value of the second sensor; and an adding and subtracting circuit configured to add and subtract a required numerical value to and from the output value of the amplifying circuit, and an output value of the adding and subtracting circuit is set as the second sensor output correlation threshold value.

4. The fixing apparatus according to claim 3, further comprising:

a plurality of amplifying circuits comprising different amplification factors; and a plurality of adding and subtracting circuits comprising different addends or subtrahends; wherein the computing circuit comprises the amplifying circuit and the adding and subtracting circuit for each of the plurality of threshold lines.

5. The fixing apparatus according to claim 4, wherein the detecting circuit is configured to detect a threshold line corresponding to the output value of the second sensor among at least three threshold lines.

6. The fixing apparatus according to claim 5, wherein the heating roller is constructed to generate heat upon electric conduction; and the controlling circuit comprises a switch for stopping the electric conduction when the difference value is equal to or higher than the threshold value.

7. An image forming apparatus comprising:

a transferring apparatus configured to transfer an image by a developer onto a sheet based on obtained image data; and the fixing apparatus according to claim 1, wherein the image is fixed by the fixing apparatus to perform image formation.

* * * * *